US006758631B2

(12) United States Patent
Frankeny, II

(10) Patent No.: US 6,758,631 B2
(45) Date of Patent: Jul. 6, 2004

(54) PORTABLE SCREED GUIDANCE SYSTEM

(76) Inventor: Albert D. Frankeny, II, 17105 Brookdale La., Round Hill, VA (US) 20141

( * ) Notice: Subject to any disclaimer, the term of this patent is extended or adjusted under 35 U.S.C. 154(b) by 0 days.

(21) Appl. No.: 10/266,639

(22) Filed: Oct. 9, 2002

(65) Prior Publication Data

US 2004/0071509 A1 Apr. 15, 2004

(51) Int. Cl.[7] ..... E01C 19/24

(52) U.S. Cl. ..... 404/118; 404/84.5; 404/84.1

(58) Field of Search ..... 404/118, 119, 404/120, 72, 84.05, 84.1, 84.2, 84.5, 84.8

(56) References Cited

U.S. PATENT DOCUMENTS

| | | | | | |
|---|---|---|---|---|---|
| 4,386,901 | A | * | 6/1983 | Morrison | 425/456 |
| 4,591,291 | A | * | 5/1986 | Owens | 404/118 |
| 4,655,633 | A | | 4/1987 | Somero et al. | |
| 4,752,156 | A | * | 6/1988 | Owens | 404/118 |
| 4,838,730 | A | * | 6/1989 | Owens | 404/114 |
| 5,039,249 | A | * | 8/1991 | Hansen et al. | 404/84.5 |
| 5,190,401 | A | * | 3/1993 | Wilson | 404/118 |
| 5,567,075 | A | * | 10/1996 | Allen | 404/84.5 |
| 5,568,992 | A | * | 10/1996 | Grembowicz et al. | 404/101 |
| 5,862,501 | A | | 1/1999 | Talbot et al. | |
| 6,089,787 | A | | 7/2000 | Allen et al. | |
| 6,227,761 | B1 | * | 5/2001 | Kieranen et al. | 404/84.5 |
| 6,322,286 | B1 | * | 11/2001 | Rijkers | 404/114 |
| 6,530,721 | B2 | * | 3/2003 | Yost | 404/84.5 |
| 6,558,073 | B1 | * | 5/2003 | Wrazidlo | 404/133.05 |

FOREIGN PATENT DOCUMENTS

JP 2001131908 A * 5/2003 ..... E01C/19/48

OTHER PUBLICATIONS http://www.vibrastrike.com/Products.htm, "Vibrastrike Products Page—Vibra Strike I" Feb. 24, 2002, pp. 1–2.
http://www.alleneng.com/html_magicscreeds/, "Allen Engineering Corporation: Magic Screeds" Feb. 24, 2002, pp. 1–5.
http://www.alleneng.com/products.html, "Allen Engineering Corporation: Our Complete Line of Products", Feb. 24, 2002, pp. 1–3.
http://www.alleneng.com/html_trusscreeds/12shed.html, "Allen Engineering Corporation Steel Truss Screed—12SHED", Feb. 24, 2002, pp. 1–3.
http://www.somero.com/p_s100asp, "Somero Enterprises—Somero S–100 Laser Screed", Feb. 24, 2002, pp. 1–4.
http://www.somero.com/p_3dasp, "Somero Enterprises—Somero 3–D Profiler System", Feb. 24, 2002, pp. 1–2.
http://www.faceco.com/40q.html, "The Face Companies—The 40 Most Asked Questions about F–Numbers", Mar. 21, 2002, pp. 1–11.
Author: Eldon Tipping, "Bidding and building to F–number floor specs", 1992, pp. 1–3.

* cited by examiner

*Primary Examiner*—Thomas B. Will
*Assistant Examiner*—Alexandra K. Pechhold
(74) *Attorney, Agent, or Firm*—Hunton & Williams

(57) ABSTRACT

A guidance system for providing control over the height and inclination of a portable screed is provided. The guidance system includes an inclination measuring device for measuring an inclination, an inclination display for displaying the measured inclination to an operator, a level measuring device for measuring a height relative to a reference signal, and a level display for displaying the measured height to the operator. The inclination measuring device, inclination display, level measuring device and level display can be mounted on a portable screed. The inclination display and the level display are adapted to be used by the operator to guide the portable screed.

34 Claims, 6 Drawing Sheets

PORTABLE SCREED GUIDANCE SYSTEM

FIELD OF THE INVENTION

The present invention relates generally to concrete screeding devices, and more specifically to a combined level- and angle-controlling guidance system for portable concrete screeding devices.

BACKGROUND OF THE INVENTION

Concrete screeds are used in the concrete industry to level freshly-poured concrete (sometimes referred to as plastic concrete). A number of different types of screed are used for various different applications. Typically, automated screeding devices, such as large laser guided mobile screeds and/or truss screeds, are used to level large and easily accessible concrete pours. An example of a mobile screed is provided in U.S. Pat. No. 4,655,633 to Somero et al., and examples of truss screeds are provided in U.S. Pat. No. 4,586,889 to Krohne et al. and U.S. Pat. No. 4,806,047 to Morrison, all of which are incorporated herein by reference. Manually operated lightweight portable screeds, which may be operated by one or two operators, generally are used to level concrete in small or difficult to reach areas, and areas that have physical obstructions such as piping or conduit. An example of a portable screed is provided in U.S. Pat. No. 4,386,907 to Morrison, which is incorporated herein by reference. Portable screeds also may be desirable when the underlying substrate onto which the concrete is being poured is too weak to hold a mobile screed or can not be truss screeded. For example, portable screeds are often preferred when the concrete is poured on elevated decks or when the presence of pipes or other obstructions prevents the use of forms to guide a truss screed.

Modern concrete contractors often are required to meet industry standards for floor flatness and levelness. Typical standards include American Society for Testing of Materials standard E 1155, American Concrete Institute standard #117, and Canadian Standards Association standard A23.1. These standards specify standards for measuring floor flatness ($F_F$) and floor levelness ($F_L$). Floor flatness generally measures the waviness of the floor, and floor levelness generally measures the deviation from a horizontal plane. $F_F$ and $F_L$ measurements are unitless measurements of relative quality, with higher quality floors having higher $F_F$ and $F_L$ numbers. The various types of screed provide different quality floors, and those familiar with the art generally regard manually operated portable screeds as being less capable of creating a flat, level floor than automated screeds. Typical manual screeding methods provide $F_F$ and $F_L$ measurements of 36 and 20, respectively, although with more care (and greater expense), a manual screeding operation may produce floors of $F_F45/F_L30$ quality. In contrast, automated screeds typically provide average $F_L$ values of approximately 35, and correspondingly higher $F_F$ values.

Portable screed users have devised a number of operation methods in efforts to improve the quality of screeding provided by portable screeds. Portable screed operators typically use a laser leveling system to create reference guides in the plastic concrete then attempt to move the screed blade on the guides to produce a flat and level floor. The laser leveling system usually comprises a 360 degree planar reference laser that emits a laser in all directions and a laser receiving eye adjustably mounted on a post. The laser eye indicates whether it is level with, above, or below the reference laser. The laser eye is adjusted on the post so that when the laser eye is level with the reference laser, the foot of the post is at the desired concrete height. The post is then used to establish a number of reference points in the plastic concrete having the desired concrete height. A straightedge, such as a highway level, is used to trowel the concrete between the reference points into parallel guide lanes having the desired height. Once this is complete, the operators position the screed with one end on each guide lane and drag the screed along the guide lanes to level the concrete between the lanes. As the operators move along, another worker may use the laser eye and post to measure the screeded concrete to ensure that it is within tolerances.

This conventional method of operating portable screeds is relatively inaccurate, and is made difficult by a number of factors. For example, the concrete tends to form a roll of grout along the leading edge of the screed blade, obscuring the operators' view of the guide lanes.

Various other attempts have been made to increase the accuracy of portable screeds by attaching a laser leveling system directly to the portable screed. Typically, such systems have a pair of laser eyes mounted directly to the portable screed so that the operator or operators can continually assess the height of the screed relative to the reference laser during screeding and make adjustments accordingly. Examples of such devices are provided in U.S. Pat. No. 4,752,156 to Owens, U.S. Pat. No. 4,838,730 to Owens, and U.S. Pat. No. 6,089,787 to Allen et al., each of which is incorporated by reference herein. Such attempts to provide more accurate portable screeds have met with disappointing results, and generally have not been successful on the marketplace because they do not provide a substantial improvement in floor levelness and flatness.

Despite their imprecision, portable screeds remain in popular use because they are relatively fast and convenient, and can be used where more accurate screeds can not reach or operate. In some cases, however, a concrete contractor that is using portable screeds may determine that the portable screed is unable to meet the $F_F$ and $F_L$ requirements for a particular construction job without expensive finishing procedures or multiple screeding attempts. In these cases, the contractor may have to employ a more accurate truss screed or mobile laser-guided screed to meet the average $F_F$ and $F_L$ requirements for the job. The use of truss screeds and mobile laser-guided screeds is expensive, however, and many contractors can only afford to rent such screeds for particular jobs or for a limited time. Those contractors that can not afford to rent or own the more expensive screeds may be relegated to working on jobs that have less stringent floor quality requirements.

In light of the state of the prior art, a need still exists to provide more accurate portable screeds. Such screeds preferably will allow contractors to produce high quality floors without relying on truss screeds, mobile laser-guided screeds, and other such expensive and cumbersome machinery.

SUMMARY OF THE INVENTION

Accordingly, it is an object of the present invention to provide a guidance system for a portable screed having an inclination measuring means for measuring an inclination, an inclination display means for displaying the measured inclination to an operator, a level measuring means for measuring a height relative to a reference signal, and a level display means for displaying the measured height to the operator. The inclination measuring means, inclination display means, level measuring means and level display means are mountable on a portable screed and the inclination display means and the level display means are adapted to be used by the operator to guide the portable screed.

In various embodiments of the invention, the inclination measuring means is a mechanical or electronic inclinometer. In other embodiments, the level measuring means may be a laser sensor eye that receives a signal from a reference laser. One or both of the measured inclination and level may be displayed on an electronic display, which may be remote from the measuring means, may be mounted on a control panel, or may be integrated into a control unit.

In other embodiments of the invention, the guidance system may also include a tilt measuring means for measuring tilt and displaying it to an operator.

It is another object of the invention to provide a method for guiding a portable screed. The method involves measuring a reference inclination of the portable screed, measuring the vertical position of the portable screed relative to a reference plane, controlling the inclination of the portable screed during screeding to maintain the inclination of the portable screed within a desired tolerance of the reference inclination, and controlling the elevation of the portable screed during screeding to maintain the vertical position of the portable screed within a desired tolerance of the reference plane.

It is yet another object of the present invention to provide a portable screed that has one or more blades, one or more handles, one or more inclination sensors adapted to measure and indicate the inclination of the portable screed during screeding, and one or more level sensors adapted to measure and indicate the vertical position of the screed relative to a reference signal during screeding.

In one embodiment, the portable screed is a two-man screed that has two sets of handles. An inclination sensor and level sensor may be mounted proximal to each set of handles.

DETAILED DESCRIPTION OF THE PREFERRED EMBODIMENTS

As understood herein, the term "screed" refers to portable screeds that are used to level plastic or wet concrete. The term "level" refers to measurements of vertical height. The terms "inclination" and "tilt" refer to angular orientation relative to a horizontal plane defined by the desired plane of the finished concrete surface. "Inclination" generally refers to the fore-aft angular orientation of a screed in a plane orthogonal to the axis of the screed blade's long axis. "Tilt" generally refers to the lateral angular orientation of a screed in a plane parallel to the screed blade's long axis and perpendicular to the desired plane of the finished concrete surface (i.e. orthogonal to the blade's tilt axis). Tilt and inclination are depicted graphically in FIG. 1.

The term "operatively associated," as understood herein, describes the physical association of two or more parts or devices such that they are connected to one another either directly or indirectly. The connection between the parts may be permanent, temporary or re-attachable, and may be direct or through one or more intermediate parts. The connections may be established by any known or later discovered device, means or method.

"Display," as understood herein, refers to providing information in any manner, such as visually, audibly or by any other useful communication medium.

Figure 1:
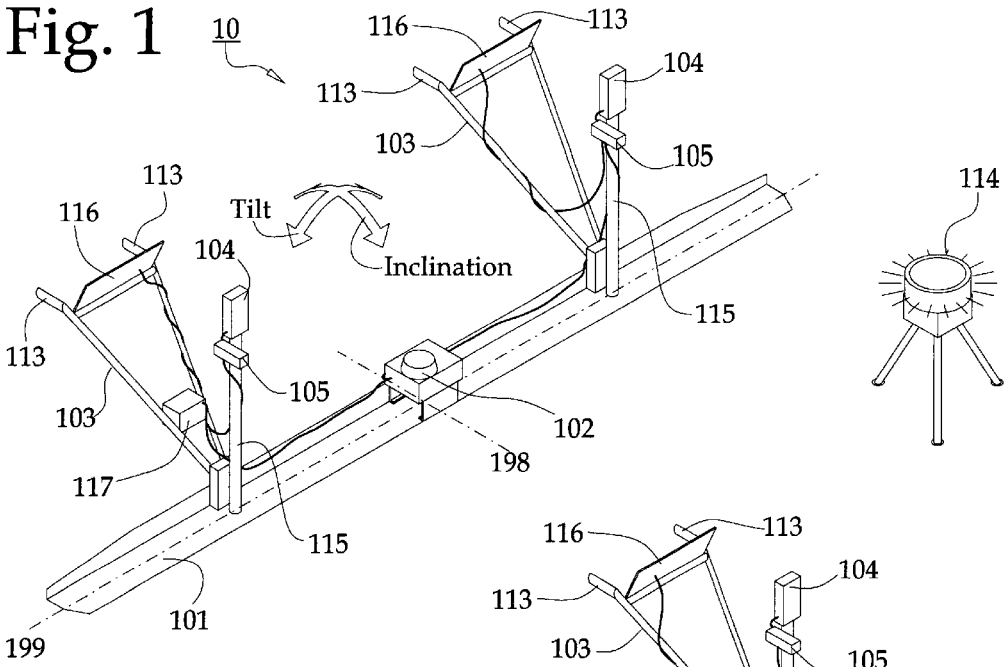
FIG. 1 is an isometric view of a preferred embodiment of a two-man portable screed of the present invention.
Figure 2:
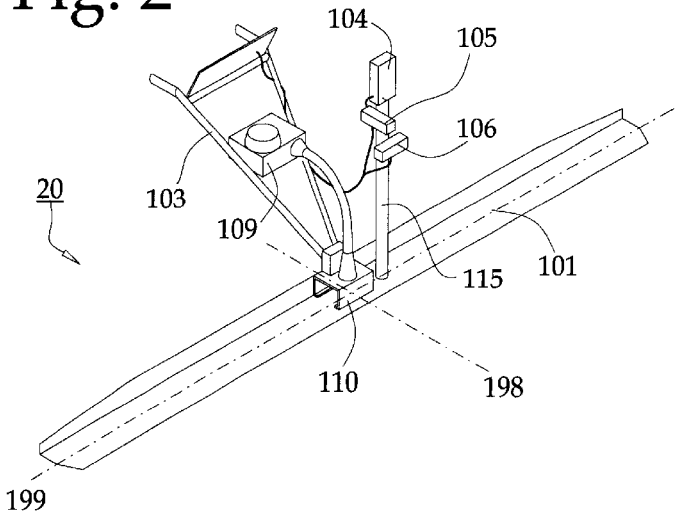
FIG. 2 is an isometric view of a preferred embodiment of a one-man portable screed of the present invention.

Preferred embodiments of the present invention will now be described with reference to the Figures in which like reference numbers refer to like parts. FIG. 1 is an isometric depiction of a two-man screed of the present invention. A screed 10 of the present invention generally comprises a blade 101, one or more vibrator assemblies 102, a handle or handles 103, one or more laser sensor eyes 104, and one or more inclinometers 105. Similarly, an embodiment of a one-man screed 20 is shown in FIG. 2. The one-man screed 20 generally comprises the same components as a two-man screed, but also comprises a tilt gauge 106, the function of which is described later herein in more detail.

A screed of the present invention comprises a blade 101 for striking off, or leveling, the plastic concrete. The blade 101 may be of any conventional design, as are well known in the art, and the present invention is not intended to be limited to the use of any particular blade. It is desirable for the blade 101 to be as straight as possible to provide a consistent and smooth concrete surface. Typical blades are made from extruded aluminum or other straight lengths of material. Preferably, the lower surface of the blade 101 has a large surface area to resist sinking into the concrete. Such blades are known as floating blades, and are disclosed generally in U.S. Pat. No. 4,838,730. The blade 101 also may be of a non-floating type or any other type known in the art or later developed. The blade 101 typically further comprises a vertical portion that rises from the leading edge of the blade 101. The front plane 108 may be flat or curved, and preferably is contoured to facilitate control of the plastic concrete, as will be understood by those skilled in the art. The blade 101 also may have a multi-piece design that allows a number of blades to be attached at their ends to make the blade longer, such as those disclosed in U.S. Pat. No. 6,089,787, which is incorporated herein by reference. Blades are commercially available from Allen Engineering Corporation of Paragould, Arkansas, Lindley Incorporated of Boaz, Ky., and other suppliers.

A vibrator assembly 102 preferably is operatively associated with the blade to shake the blade to assist with concrete screeding. The vibrator assembly 102 may be of any conventional design, as are well known in the art, and the present invention is not intended to be limited to the use of any particular vibrator. The vibrator assembly 102 preferably comprises a self-contained gasoline engine 109 that drives a vibrator head 110, such as eccentric weight. The engine 109 and vibrator head 110 may be an integral device or separate connected devices. In one embodiment, the engine 109 may be flexibly or rigidly mounted on the blade 101 itself, with the vibrator head 110 attached proximal to the engine 109 and the blade 101, such as in the embodiment of FIG. 1. In another embodiment, as shown in the one-man screed 20 of FIG. 2, the engine may be operatively associated with the screed 20 at a location remote from the blade 101, such on the handle 103 or at the end of the handle, and connected by a rigid or flexible drive conduit 111 to a vibrator head 110 that is rigidly or flexibly mounted on the blade 101.

Figure 3:
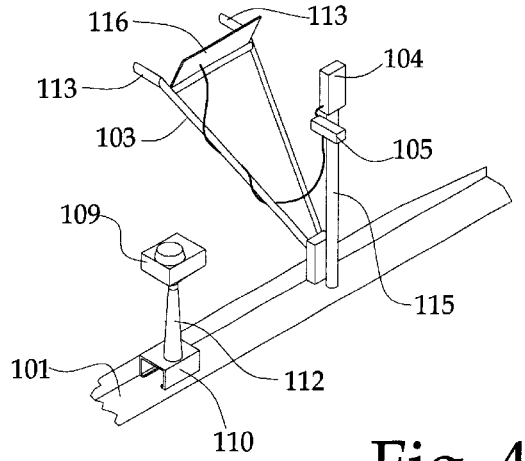
FIG. 3 is a partially cut-away view of an alternative vibrator assembly shown installed on the screed of FIG. 2.

In still another embodiment, shown in FIG. 3, the vibrator head 110 may be mounted proximal to the blade 101, and the engine 109 may be mounted vertically above the blade 101 by a rigid housing 112. In this preferred embodiment, the engine is raised to prevent undesirable contact with splattered wet concrete and to allow operators easy access to start and adjust the engine. Preferably the engine is low enough, however, to prevent unwanted fore-aft swaying. Other configurations may be employed, and the present invention is not intended to be limited to any particular configuration for the vibrator assembly 102, engine 109 or vibrator head 110.

In a preferred embodiment, a single vibrator assembly 102 is mounted at the center of the blade 101. In this embodiment, the weight of the portable screed 10 may be minimized by using only one vibrator assembly 102. Furthermore, it has been found that some engines 109 used to power vibrator assemblies 102 create electromagnetic, radio frequency, or other signals that may disturb the operation of the laser sensor eyes 104 and inclinometers 105 that are used to control the screed, and positioning the engine between the eyes 104 and inclinometers provides some shielding of these signals. Of course, other shielding may be provided to the sensors and/or the engine to minimize any disturbances caused by such signals.

The vibrator assembly 102 also may comprise other devices, such as a self-contained or remotely powered electric or pneumatic device. Remotely powered devices may rely on a power line or pneumatic line to be attached to the screed 10 and monitored as the screeding is performed to ensure that it does not become entangled or damaged. For this reason, self-contained devices such as gasoline engines are preferred. A self-contained electric vibrator may be powered by battery packs carried by the operators. Various examples of suitable vibrator assemblies 102 are disclosed in U.S. Pat. No. 4,591,291 to Owens, U.S. Pat. Nos. 4,752,156, 4,838,730 and 6,089,787, each of which is incorporated herein by reference. Of course, any other suitable vibration creating means may be used with the present invention, as will be understood by those skilled in the art.

For a two-man screed 10, two sets of handles 103 preferably are operatively associated with the blade 101 to provide each operator with control over a portion of the blade's movement. In contrast, one-man screeds 20 generally have a single set of handles 103. Screed handles 103 are well known in the art, and it will be understood that any suitable handle may be used with the present invention. Preferably, each set of handles 103 has one or more grips 113, which, if a floating blade is used, preferably are positioned on one side of the blade 101, as shown in the Figures. It is also preferred that the handles be lightweight to minimize user fatigue and provide better float on the plastic concrete surface, as such, handles made from aluminum or other lightweight materials are preferred. If a non-floating blade is used, it may be desirable to position one or both grips 113 vertically over the blade 101, as shown in U.S. Pat. No. 4,752,156, so that the operators can more easily lift the blade 101 and prevent it from sinking into the concrete. The handles 103 and/or grips 113 may be adjustable so that various operators can move them to a favorable position for comfort and control. Suitable handles 103 and vibrator assemblies 102 are available from Allen Engineering Corporation under the trade name MAGIC SCREED, from Lindley Incorporated under the trade name VIBRA STRIKE I and VIBRA STRIKE II, and from other sources.

The screeds 10, 20 of the present invention are provided with a vertical level (height) measuring means that indicates to an operator whether the blade is at the proper height. The level measuring means may comprise any suitable device that determines its vertical position relative to the desired floor height. Laser sensor eyes 104 are exemplary for use as the level measuring means. Laser sensor eyes 104 operate in conjunction with a reference laser 114 that projects a laser beam at a predetermined reference height. The reference laser 114 preferably is a 360 degree laser that creates a plane-like laser projection so that the eyes 104 can receive the reference signal from any location. Preferably, the eyes 104 also have a 360 degree receiving means so that they can receive the reference laser signal without having to be turned towards the reference laser 114 as the screed is used in different locations on the jobsite. Laser sensor eyes 104 and reference lasers 114 are well known in the art, and a skilled artisan will be able to employ any of the commercially available eyes 104 and reference lasers 114 without undue experimentation based on the teachings herein. Typical laser sensor eyes 104 are available under the trade names: SR21 LASER RECEIVER from Trimble Navigation Ltd. of Sunnydale, Calif., and LIGHTNING LASER DETECTOR from Apache Technologies, Inc. of Dayton, Ohio. Other laser sensor eyes 104 having a suitable tolerance or "dead zone" (i.e., accuracy) also may be used. Preferably the accuracy of the laser sensor eye 104 is about plus or minus ⅛ inch, and more preferably about 1/16 inch. The SR21 LASER RECEIVER has 360 degree receiving capability. Typical reference lasers 114 are available under the trade names: SPECTRA PRECISION LASER PLUS from Trimble Navigation Ltd., LIGHTNING LASER SYSTEM from Apache Technologies, Inc. of Dayton, Ohio, and RL-H3C from Topcon Laser Systems, Inc. of Pleasanton, Calif.

Other level measuring means also may be used with the present invention, as will be understood by those skilled in the art. For example, an infrared or visible light sensor may be used in conjunction with a projected light beam. As another example, the level measuring means may comprise eyelets on the screed that are guided along taut reference wires. Still further, the level measuring means may comprise a local telemetric positioning system that calculates its level based on a number of transmitted or reflected reference signals in known locations.

The preferred laser sensor eyes 104 are operatively associated with the blade 101 so that they effectively track the blade's movement. The eyes 104 are positioned towards opposite ends of the blade 101 so that the ends of the screed 10 can be held at the same height, thereby reducing or eliminating any tilt about the screed's tilt axis 198. Preferably, the laser sensor eyes 104 are mounted on adjustable mounts that allow the screed 10 to be adjusted to match different reference laser heights and to create any desired concrete floor height. Generally, lowering the eyes 104 relative to the blade 101 provides a higher floor and raising the eyes 104 relative to the blade 101 provides a lower floor, because the operators maintain the eyes 104 at the level of the reference laser 114. The principles of providing adjustably mounted laser sensor eyes 104 are known in the art and disclosed, for example in U.S. Pat. No. 4,752,156, which has been incorporated herein by reference. Preferably, the adjustable mount allows vertical and rotational adjustment of the eyes 104, although rotational adjustment may not be necessary if the laser sensor eyes 104 have 360 degree receiving capability.

Figure 4:
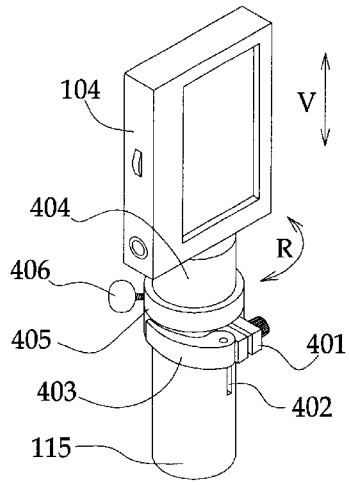
FIG. 4 is an isometric view of a preferred embodiment of an adjustable mount for a level sensor that may be used with the present invention.

Preferably, the laser eyes 104 are attached to the handles 103 by masts 115 so that the eyes 104 and reference laser 114 can be positioned away from the concrete where they are less likely to be damaged. A preferred mount for the eyes 104 is shown in FIG. 4. The preferred mount comprises a tubular mast 115 having a quick-release collar 401 attached to its end. The quick-release collar comprises a cam lever 403 that, when in the closed position, cinches the tubular mast 115 by narrowing a slot 402 that extends axially from the end of the mast. A post 404 fits within the mast 115 and is secured in place when the quick-release collar 401 is closed. The laser sensor eye 104 is mounted to the post 404, and can be adjustably positioned vertically V or rotationally R to any desired position. In embodiments in which the laser sensor eyes 104 do not have 360 degree receiving capability, it may be desirable to rotate the eyes 104 periodically during screeding to continue to receive the reference laser signal. In such an embodiment, a lock collar 405 may be affixed to the post 404 by a thumbscrew 406 or other locking device such that the lock collar 405 prevents the post 404 and eye 104 for moving downward when the quick release collar 401 is loosened to rotate the post 404 and eye 104.

In operation, the reference laser sends 114 a 360 degree signal that is received by the eyes 104. The eyes 104 indicate to the operators whether they are above, below, or level with the reference signal, and the operators can make adjustments accordingly to ensure that the eyes 104 stay at the proper level. The basic precepts of this method of using laser sensor eyes 104 to guide a portable screed is generally known in the art and disclosed, for example, in U.S. Pat. Nos. 4,752,156, 4,838,730 and 6,089,787, each of which has been incorporated herein by reference.

Figure 5:
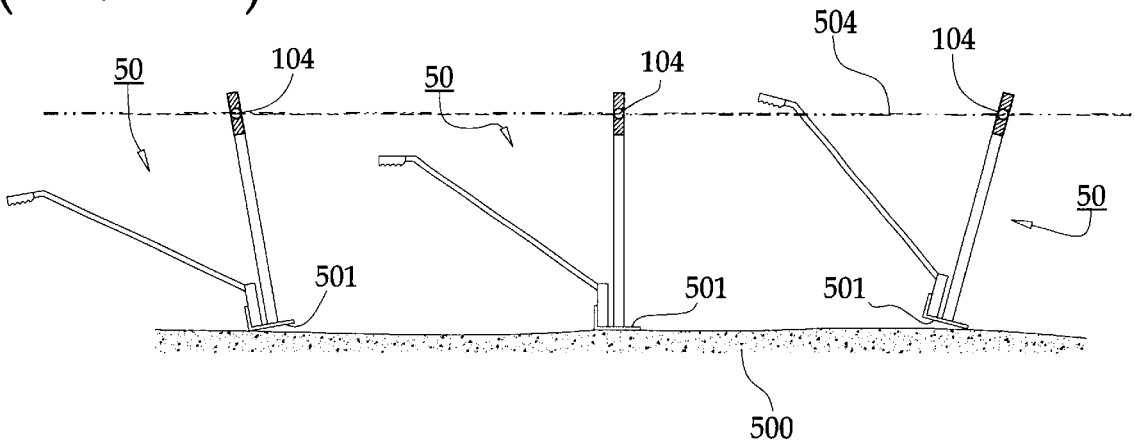
Fig. 5 (Prior Art)
FIG. 5 is a composite side view of a prior art screed shown in various stages of operation.
Figure 6:
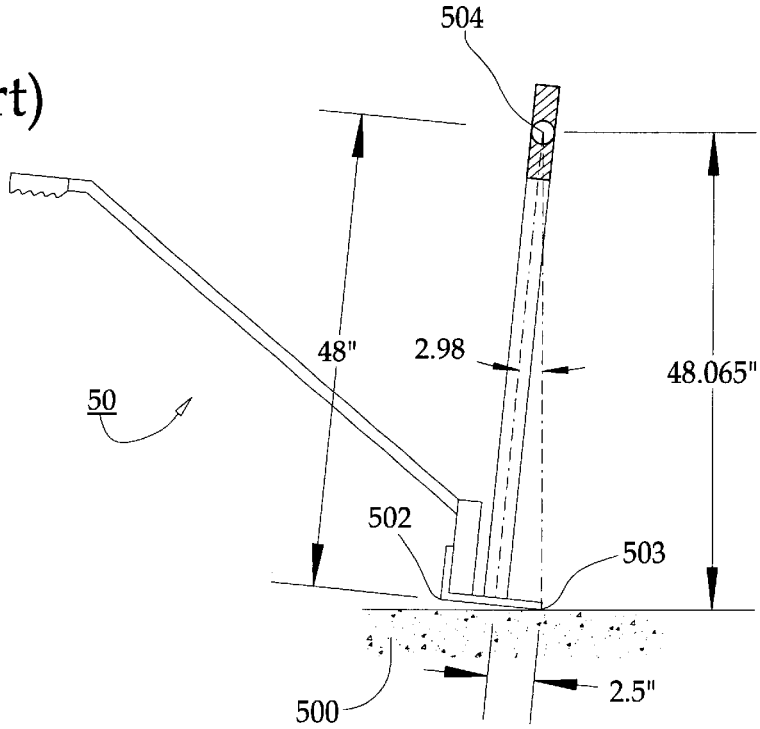
Fig. 6 (Prior Art)
FIG. 6 is a side view of a prior art screed shown in an inclined orientation.

The inventor of the present invention has discovered, however, that the known methods and apparatuses for using laser sensor eyes 104 (or other level measuring means) with portable screeds are deficient because they fail to account for inclination changes of the screed that cause undesirable variations in the height of the finished concrete surface. This defect with the prior art is explained with reference to the typical prior art laser-guided portable screed 50 is shown in FIGS. 5 and 6. In FIG. 5, a prior art laser guided screed 50 is shown in three positions. As the prior art screed 50 of FIG. 5 is drawn across the plastic concrete 500, it is free to rotate even though the laser eye 504 is constantly held at the appropriate height of the reference laser beam 514. Designers and operators of prior art laser-guided screeds failed to recognize that the screed 50 is susceptible to an unregulated pendulum-like motion below the laser eye 504 that can lead to substantial variations in the height of the finished concrete.

The substantial variation in floor height exhibited by prior art laser-guided screeds is demonstrated with reference to FIG. 6. The prior art screed 50 of FIG. 6 is shown with typical dimensions: the laser eye 504 is 48 inches above the blade 501 and centered above the blade's centerline, and the blade 501 has a chord (distance from the leading edge 502 to the trailing edge 503) of 5 inches. The prior art screed 50 of FIG. 6 is shown rotated at an angle of 2.98 degrees (which is exaggerated in FIG. 6); an angle that is difficult or impossible for an operator to detect with the naked eye, especially during screeding. As a result of this inclination, the trailing edge 503 of the blade 501 is positioned approximately 48.065 inches from the laser eye 504, rather than 48 inches as the operator would expect (the calculation of this distance is a matter of simple geometric relationships, as will be understood by those skilled in the art). As the operator screeds the concrete by referring to the laser eye's position relative to the reference laser, the height of the concrete will actually be 0.065 inches below the desired level, despite the fact that the operator is accurately following the reference laser signal.

In this typical example, this phenomenon causes an error of more than 1/16 inch, while indicating to the operator that the screed is in the proper position. Such an error is sufficient to substantially degrade the $F_F$ and $F_L$ measurements of a concrete floor. The degree of error increases as blades with larger chords are used (as is common with floating blades), and also may increase if the laser sensor eye 504 is positioned somewhere other than directly over the centerline of the blade 501. Designers and operators of prior art screeds failed to recognize or understand the error caused by the unregulated pendulum-like motion of the blade below the laser sensor eye, and for at least this reason attempts to employ prior art laser-guided portable screeds have met with disappointing results.

The portable screeds of the prior art fail to provide any useful inclination controls. Bubble levels, such as those shown in U.S. Pat. No. 4,752,156 may be useful for establishing an initial inclination, but become useless during operation because the vibration of the screed disintegrates the sight bubble into an unreadable cluster of minute bubbles. In addition, such bubble levels typically provide relatively imprecise readings. The present invention provides an inclination measuring means that allows an operator to constantly monitor and control the inclination of the screed during screeding to reduce or eliminate floor height variations caused by the unchecked pendulum-like motion of the portable screeds of the prior art.

Referring back to FIGS. 1 and 2, in a preferred embodiment, the inclination measuring means comprises an electronic inclinometer 105 that may use any suitable digital or analog measuring and display means. Nonlimiting examples of electronic inclinometer displays include number readouts that display inclination in degrees (or other units) and digital (such as LCD) readouts that graphically display a representation of the inclination. The inclinometer 105 may be a separate device or may be integral with the laser sensor eye 104 or other level sensing means. Such inclinometers are commercially available from R&B Manufacturing of Riverside, Missouri and Apache Technologies, Inc. of Dayton, Ohio. In an embodiment of the invention comprising a digital inclinometer 105, the inclinometer 105 may be mounted in any orientation that allows it to measure the fore-aft inclination of the screed in the plane orthogonal to the blade's long axis 199. A digital or electronic inclinometer 105 preferably is adjustably mounted so that can be set to provide a zero reading (i.e. the inclinometer is parallel to the ground) when the screed is at the desired operating inclination. Such a mounting position provides the operators with a simple reference point for maintaining the inclination of the screed. An adjustable mounting is particularly useful in those cases in which it is desirable to operate the screed 10 so that the blade is at an angle to the concrete (i.e., with the leading edge or trailing edge being raised or lowered), as may be desirable to provide optimum screeding for particular concrete conditions. In this case, the screed 10 may be set up at the desired inclination to provide ideal screeding performance with respect to quality and speed of operation then adjusted relative to the reference laser to screed the concrete at the proper height.

A preferred digital or electronic inclinometer 105 also may be provided with a zeroing or "tare" function that resets the reference angle to zero, regardless of the orientation of the inclinometer 105. In such a case, the screed 10 can be set to the ideal operating position and the inclinometer 105 can be reset to indicate a zero value for the inclination at that position, without having to be adjustably mounted.

In still another embodiment, the blade 101 may be adjustably mounted to the screed 10 so that the screed 10 may be operated in an upright position for all concrete conditions. In such a case, if it is desired to operate the blade 101 at a particular angle to optimize screed performance, the blade may be manually or automatically tilted relative to the rest of the screed 10. The angle of the blade may also be adjustable during operation so that the operators can constantly change the blade angle for changing concrete conditions. In this embodiment, the inclinometer 105 may not require a tare function, and may be operated in a constant level attitude without the need to adjust it whenever the angle of the blade is changed. This embodiment has the advantage that the vibrator assembly 102 and other weighty portions of the screed 10 may be maintained directly above the blade 101 regardless of the blade's angle.

It is also envisioned that the digital or electronic inclinometer 105 may be fixedly mounted to the screed (i.e. so that it can not be adjusted). In such a case, the mounting of the inclinometer may be simplified to reduce costs. When operating a screed with a fixedly mounted inclinometer it may be necessary for the operators to use a reference angle equal to something other than zero (if the inclinometer doesn't have a "tare" function), depending on the reading of the inclinometer 105 at the desired setup angle. For example, it may be found that the inclinometer 105 reads an angle of 83 degrees when the screed is providing optimal screeding performance. In such a case, the operators should maintain the screed at 83 degrees and maintain the laser sensor eyes 104 at the height of the reference laser 114 during screeding.

Figure 7:
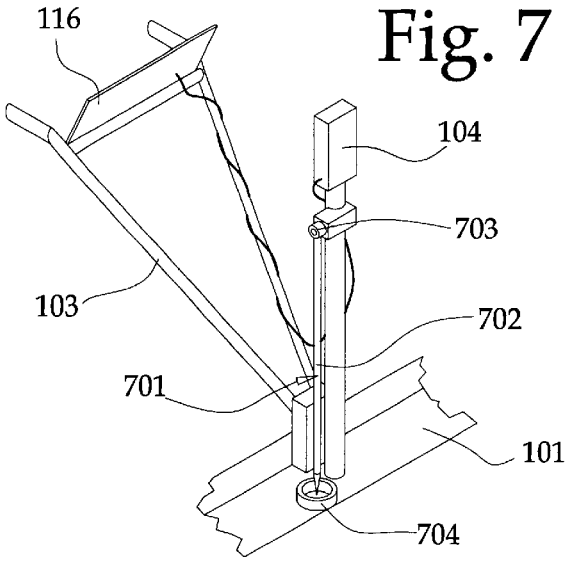
FIG. 7 is a partially cut-away view of an embodiment of a mechanical inclinometer shown installed on the screed of FIG. 1.

In another embodiment of the invention, shown in FIG. 7, a mechanical inclinometer 701 may be used. A preferred mechanical inclinometer comprises a plumb rod 702 that is suspended by a rotatable bearing 703 such that it is free to pivot at least in the fore-aft direction as the screed 10 changes inclination. The lower point of the plumb rod 702 moves within a sight ring 704 that may be marked with graduations to indicate units of inclination such as degrees. Alternatively any other suitable reference marking device, such as graduated scales and the like, may be used to indicate the position of the mechanical inclinometer, as will be understood by those skilled in the art.

It will be understood that other types of inclination measuring means also may be used with the present invention, provided it is capable of measuring and displaying inclination during the screeding process. The present invention is not intended to be limited to the embodiments of inclination measuring means described herein. Furthermore, additional devices may be added to the screed to assist the operator or operators with maintaining the desired inclination angle. For example, the screed may comprise one or more gyroscope assemblies (not shown) that may be attached to the screed and driven by the vibrator assemblies 102 or some other power source. In one embodiment, the vibrator assembly or assemblies 102 may comprise weighted flywheels that held stabilize the screed. In another embodiment, stabilizing outriggers or blade extensions may be added to the blade 101 to assist with maintaining the proper blade angle. Such devices may be particularly useful when screeding relatively wet concrete, in which case control of the inclination and height of the screed is typically more difficult.

Referring back to FIG. 2 an embodiment of a one-man screed 20 of the present invention will now be described. The one-man screed 20 comprises substantially the same components as the two-man screed 10 described with reference to FIG. 1, except that it has only a single set of handles 103, a single level measuring means (shown as a laser sensor eye 104 in FIG. 2) and a single inclination measuring means (shown as an inclinometer 105). In addition, the one-man screed 20 may additionally comprise a tilt measuring means for determining whether one end of the blade 101 is higher than the other. The tilt measuring means may be provided by mounting two laser sensor eyes 104 on the one-man screed 20, with one reading the level of each end of the blade (it will be understood by those skilled in the art that the eyes 104 do not have to be located at the ends of the blade, but may instead be located substantially inboard and still provide useful tilt measurements). In a preferred embodiment, however, the tilt measuring means comprises a tilt gauge 106 that is substantially similar to the mechanical, electronic or digital inclinometers 106 described elsewhere herein, but which is mounted to read the lateral angular orientation of the screed about its tilt axis 198. An operator of such a one-man screed can use the tilt gauge 106 to determine whether one or both ends of the blade 101 are out of tolerance and can make adjustments accordingly.

Referring to FIG. 1, in a preferred embodiment, a portable screed of the present invention may further comprise a self-contained electrical system to power the various devices associated with the screed, such as the laser sensor eyes 104 and the inclinometer 105. In a preferred embodiment, one or more batteries 117, such as rechargeable 12 volt batteries, are mounted to the screed 10 on a handle 103 or the blade 101 and the eyes 104 and inclinometer are powered by the battery 117. In another preferred embodiment, the battery 117 may be charged by a generator attached to the vibrator assembly 102.

Figure 8A:
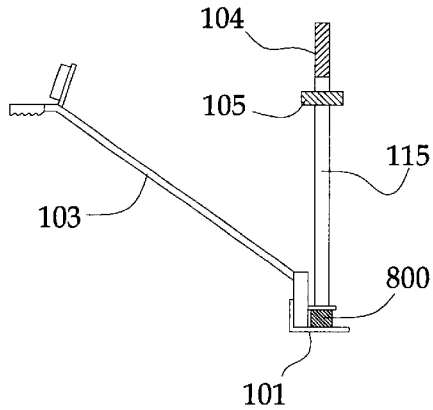
FIG. 8A is a side view of an embodiment of a mounting configuration for an embodiment of the present invention.

The laser sensor eyes 104, inclinometers 105 and tilt gauges 106 preferably are mounted on the screed 10 so that they are at least partially isolated from the vibrations caused by the vibrator assembly 102. Referring now to FIGS. 8A through 8D, a number of possible isolation mounting schemes are shown. In FIG. 8A, the eye 104 and inclinometer 105 are mounted to a mast 115, which is mounted to the screed 10 proximal to the blade 101 through a vibration damping isolation mount 800 comprising rubber, plastic, elastomeric or other vibration damping material, as are known in the art. In the preferred embodiment of FIG. 8B, the handles 103 are isolation mounted to the blade 101 by an isolation mount 800 so as to reduce operator fatigue and provide improved control over the screed 10, and the mast 115 is isolation mounted to the handles 103. The accuracy of the eyes 104 and inclinometer 105 may be improved by having numerous isolation mounts 800 between them and the blade 101. Of course in other embodiments, the handles 103 and mast 115 may be mounted by the same or separate isolation mounts 800.

It should be apparent after consideration of the teachings herein that the inclinometers 105 may be positioned at any location, provided they measure the fore-aft inclination of the screed 10. Similarly, the tilt gauges 106 may be positioned anywhere provided they measure the lateral tilt of the screed 10. Furthermore, the inclinometers 105 and tilt gauges 106 may be mounted remotely from the laser sensor eyes 104. As such, FIG. 8C demonstrates a third embodiment of a mounting system for the laser sensor eyes 104 and inclinometers 105 in which the eyes 104 are positioned vertically above the blade 101 on an isolation-mounted mast 115, but the inclinometers 105 are positioned on the handles 103, which also may be isolation-mounted to the blade 101 by the same or different isolation mounts 800 than the mast 115. Similar embodiments may be employed for a one-man screed having a tilt gauge 106, as will readily apparent to those skilled in the art.

Figure 8B:
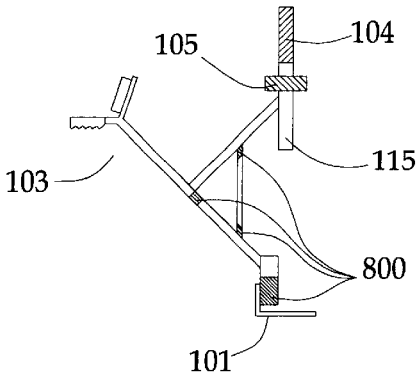
FIG. 8B is a side view of another embodiment of a mounting configuration for an embodiment of the present invention.
Figure 8C:
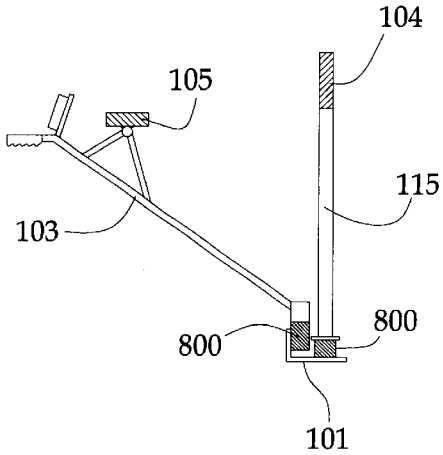
FIG. 8C is a side view of still another embodiment of a mounting configuration for an embodiment of the present invention.
Figure 8D:
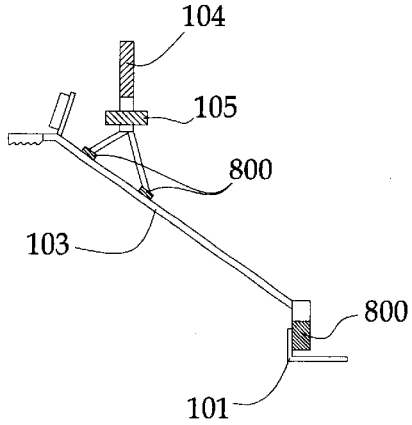
FIG. 8D is a side view of an yet another embodiment of a mounting configuration for an embodiment of the present invention.

The combined vertical and rotational control over the blade's position provided by the present invention also allows embodiments in which the laser sensor eyes 104 are positioned somewhere other than vertically over the blade 101. Such an embodiment is shown in FIG. 8D. Although such alternative embodiments are possible with and within the scope of the present invention, it is preferred to locate the laser sensor eyes 104 vertically above the blade 101 to facilitate the setup of the screed 10 because it is simpler to measure the laser sensor eye height when the eyes 104 are vertically above the blade 101.

Other mounting assemblies may be used for the present invention, as will be understood by those skilled in the art. The particular design of the mounting assembly and isolation mounts 800 may be dictated, at least in part, by the other devices comprising the screed 10, such as the particular design of the blade 101, handles 103 and vibrator assembly 102, and mounts may be adapted to fit any commercially available portable screed.

The output of the level measuring means, inclination measuring means and tilt measuring means may be displayed to the operator or operators by any display means or combination of display means known in the art. In a preferred embodiment, the inclination, level and tilt display means comprise digital or analog displays, although one or more may comprise a mechanical device, such as the sight ring 704 described elsewhere herein. Digital displays for laser sensor eyes 104 are generally known in the art, and typically comprise a lighted screen or liquid crystal display (LCD) that indicates the degree to which the laser sensor eye 104 is above or below the reference laser plane. These devices often also include an audible signal that indicates level in conjunction with the visual screen. Such displays typically are mounted on the eye 104 itself, but some laser sensor eyes 104 have displays that may be positioned remotely from the sensor to facilitate viewing. Example of such a devices are described in U.S. Pat. Nos. 6,089,787 and 4,838,730. Such devices are commercially available under the trade name LIGHTNING LASER DETECTOR from Apache Technologies, Inc. of Dayton, Ohio. The inclination and tilt display means also may be of any known type, and preferably comprise displays that may be placed remotely from the inclination and/or tilt measuring means if such a remote placement facilitates viewing the display.

One or more of the level, inclination and tilt display means may be equipped with an audible or visual signal that indicates the degree to which the sensor is out of tolerance. For example, the display means may have an audible signal that increases or decreases in pitch, frequency, tone or volume as the screed 10 is moved away from the desired position. The display means may be equipped with a speaker and/or a headphone for transmitting these audible signals. One or both of the level display means and inclination display means also may have a supervisor signal that emits an audible, visual or other signal that may be received by a person or device supervising the operators. For example, in a preferred embodiment, one or more of the display means comprises a bright light or lights that are activated when the screed is out of position. The lights may be used to convey a number of statuses, such as being green during normal operation, yellow when the sensor is out of position for a short sustained period or out of position by a relatively small amount, and red when the sensor is out of position for a long sustained period or is out of position by a relatively large amount. Other types and uses for the supervisor signal will be apparent to those skilled in the art.

The supervisor signal or other signaling device also may transmit data regarding the position of the screed to a processor to analyze the performance of the screed and possibly to predict the floor flatness and levelness measurement of the finished concrete floor. Such predictive measurements may require the use of a position sensor (or a movement rate sensor) that indicates the position of the screed in the screeding direction. By analyzing the level, inclination and position of the screed, the processor (which may be integrated onto the screed itself) may be able to provide real-time $F_F$ and/or $F_L$ measurements.

In a preferred embodiment, one or more of the level, inclination and tilt display means is mounted on the screed 10, preferably on the handles 103, so that the operator can easily refer to them during screeding. One or more of the various display means may be mounted on a control panel 116 affixed to the handles 103, such as those shown in FIGS. 1 and 2. Alternatively, the display means may be mounted directly to the handles 103 or to the operator.

Figure 9:
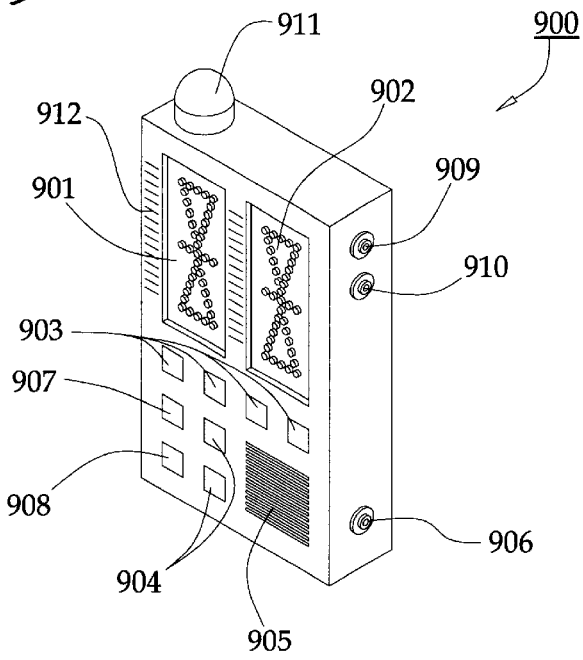
FIG. 9 is an isometric view of a preferred embodiment of a control unit of the present invention.

Referring now to FIG. 9, in another preferred embodiment, the level display means and inclination display means are integrated into a single control unit 900. The control unit 900 preferably has a level indicator 901 and an inclination indicator 902 that provide visual and/or audible signals that indicate whether the level and inclination measuring means are in the correct position and, if not, indicate how far out of position they are by, for example, illuminating a series of colored lights or bars. The indicators 901, 902 also may use flashing lights or other means to indicate how far out of tolerance the sensors are, as will be understood by those skilled in the art. The indicators 901, 902 also may be graduated to show how far out of tolerance the sensors are as measured in inches, degrees, or other suitable units. For example, one or both of the indicators 901, 902 may have a scale 912 associated with the indicator lights that indicates how far, in inches or degrees, the eyes 104 and/or inclinometer 105 are out of position. In one embodiment, the tolerance of the indicators and/or measuring means may be adjusted by a tolerance control 907. The tolerance control 907 may be adjusted to reflect the $F_F$ and $F_L$ levels that are required for the particular job, such that the tolerance becomes narrower when higher $F_F$ and $F_L$ values are required. A supervisor light 911 also may be disposed on the control unit 900 to provide signals to the operator's supervisor, as described elsewhere herein.

The preferred control unit 900 also may comprise illumination controls 903 for adjusting the brightness, contrast, color or other features of the indicators 901, 902. Volume controls 904 also may be provided to control the volume of a speaker 905 or headphones attached through a headphone jack 906. The control unit 900 preferably also comprises a power switch 908, and may be powered by batteries or any other suitable power supply source or system, as described before. The control unit 900 also may have a standby mode or power saving mode to reduce battery consumption during idle periods.

Although the control unit 900 may be integrated with one or both of the level and inclination measuring means, it is preferred that the control unit 900 is a separate remote device that may be mounted away from the level and inclination measuring means. To this end, the control unit 900 preferably comprises a level input 909 for receiving a signal from the level measuring means, and an inclination input 910 for receiving a signal from the inclination measuring means. The level and inclination inputs 909, 910 also may be integrated into a single multi-purpose input that receives signals from both measuring means.

Figure 10:
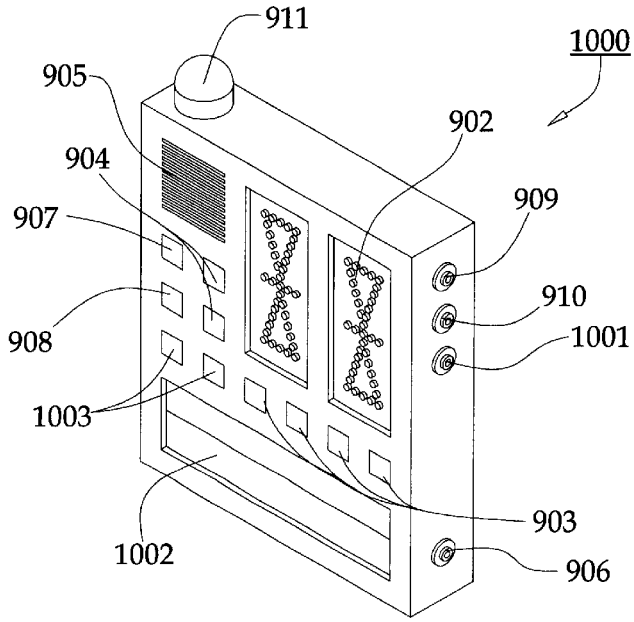
FIG. 10 is an isometric view of another preferred embodiment of a control unit of the present invention.

FIG. 10 shows an alternative embodiment of a control unit 1000 for use with a one-man portable screed 20 or any other screed having a tilt measuring means, such as a tilt gauge 106. Alternative control unit 1000 comprises the same components as control unit 900, but also includes a tilt input 1001 for receiving a signal from the tilt measuring means, and a tilt indicator 1002 (and associated illumination controls 1003) that provides visual signals to indicate whether the tilt measuring means is in the correct position and, if not, indicate how far out of position it is.

Figure 11A:
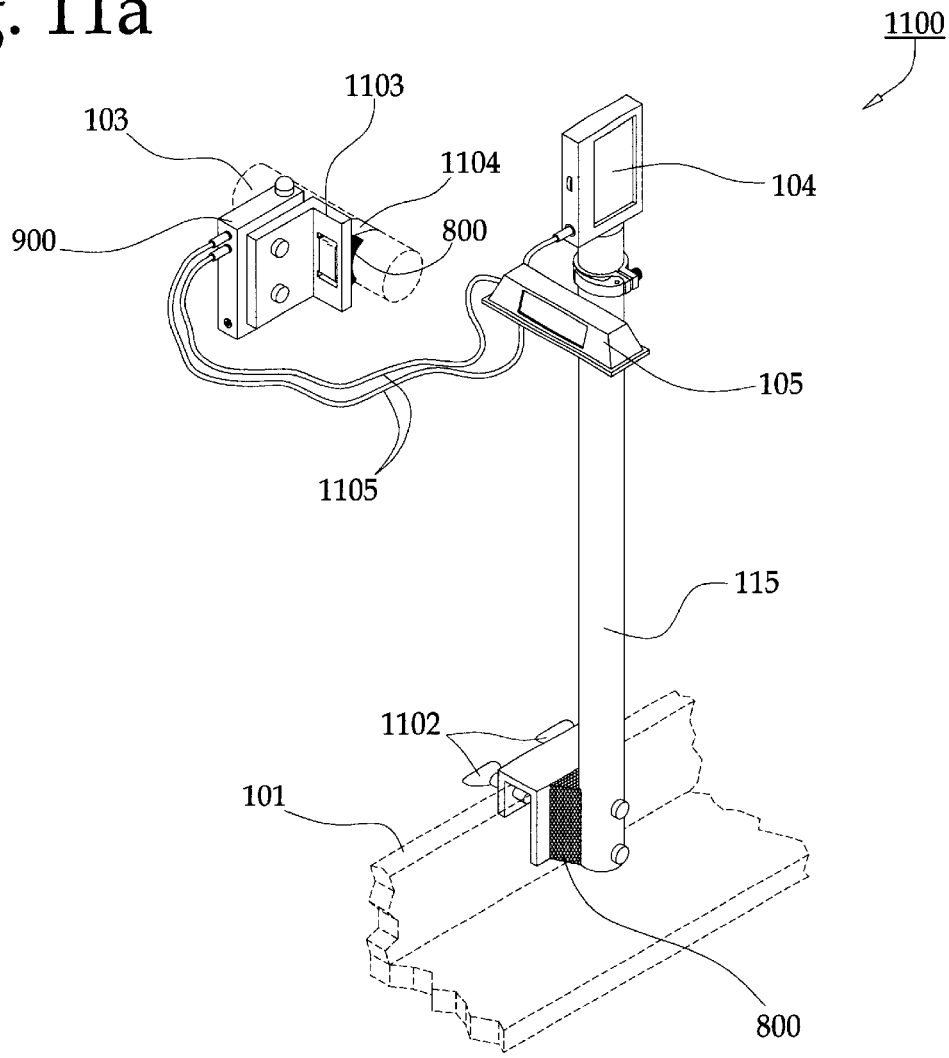
FIG. 11*a* is an isometric view of a preferred embodiment of a guidance system kit of the present invention, shown attached portions of a screed shown by dotted lines.

The present invention may be integrally formed with a portable screed or may be removably attached to a portable screed in whole or in part. Referring now to FIG. 11*a*, a preferred embodiment of a portable screed guidance system kit 1100 will be described. The guidance system kit 1100 is a self-contained system that may be attached to any portable screed to provide level and inclination control to the screed operator or operators. Such a kit 1100 may be particularly useful as a retrofit device that can be attached to a variety of existing portable screeds to provide the benefits of the present invention thereto. The kit 1100 comprises a laser sensor eye 104 (or any other suitable level measuring means) and a digital inclinometer 105 (or any other suitable inclination measuring means) that are attached to the upper portion of a mast 115. The eye 104 and/or inclinometer 105 may be adjustably mounted to the mast 115 as described elsewhere herein.

A mounting means, such as a mast mounting bracket 1101, is attached to the mast 115, preferably through an isolation mount 800. The mast mounting bracket 1101 preferably has a universal design that can be attached by one or more suitable means to many or all of the commercially available blades or other parts of commercially available screeds. For example the mast mounting bracket 1101 may comprise one or more clamping devices, such as thumb screws 1102, by which the mast mounting bracket 1101 can be attached to of any type of blade 101. In a particularly preferred embodiment, the mast 115 is isolation mounted to the handles 113, which are isolation mounted to the blade 101, as shown in FIG. 8B. Preferably, the mounting means allows quick attachment and removal of the kit 1100, so that the kit 110 can be safely stored when not in use.

The guidance system kit 1100 further comprises a control unit 900, as described elsewhere herein that is adapted to be mounted to the handles 103 or any other suitable portion of the screed. For example, the control unit 900 may be attached to a control unit mounting bracket 1103 that uses a strap 1104 to hold the handles 103. The control unit mounting bracket also may be mounted through an isolation mount 800. One or more electrical wires 1105 connect the laser sensor eye 104 and inclinometer 105 to the control unit inputs. Of course, in other embodiments, the level and inclination display means may be separate devices attached to a control panel that may be mounted on an existing screed. In still another embodiment, the laser sensor eyes 104, inclinometer 105 and control unit 900 may be attached to a single structure that is mounted on the screed. Where appropriate or desirable, a tilt gauge 106 or other suitable tilt measuring means also may be incorporated into the guidance system kit 1100, as will be apparent to those skilled in the art.

Figure 11B:
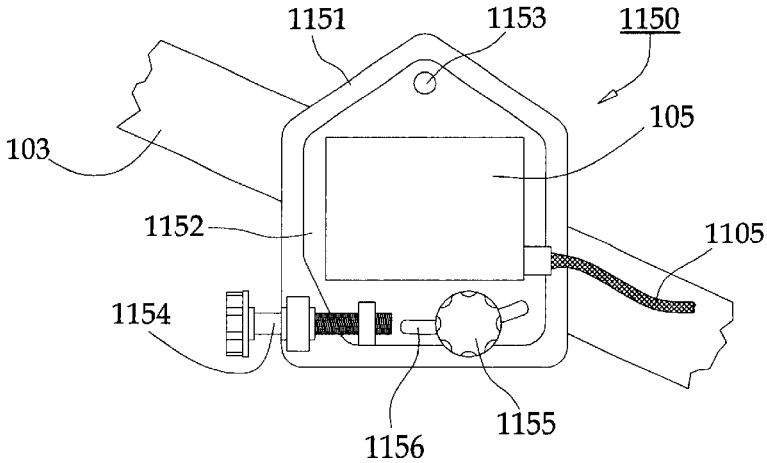
FIG. 11*b* is a side view of a preferred embodiment of a mounting system for an electronic inclinometer.

A preferred embodiment for a mounting device 1150 for an inclinometer 105 is depicted in FIG. 11*b*. The mounting device of FIG. 11*b* may be part of a guidance system kit 1100, or may be attached (either removably or permanently) to the handle or handles 103 of any other portable screed of the present invention. The mounting device 1150 comprises a back plate 1150 mounted to the handle 103 and a front plate 1151 that is pivotally mounted to the back plate 1151 by a pivot 1152. The pivot position of the front plate 1151 is controlled by an adjuster screw assembly 1153, and locked in place by a lock screw assembly 1154. Of course, any other means for controlling the angular position of the plates relative to one another also may be used, as will be appreciated by those skilled in the art. The inclinometer 105 is mounted on the front plate 1151, with its electrical wire 1105 (in the case of electronic inclinometers) extending to the remaining devices. The preferred pivoting mounting device 1150 allows the inclinometer to be zeroed, as described elsewhere herein, when it is desired to operating the portable screed at various angles of inclination. Once the desired operating inclination is achieved, the front plate 1151 and inclinometer 105 are positioned to provide a zero reading by adjusting the adjuster screw assembly 1153, and locked in place by the lock screw assembly 1154.

It is also envisioned that the screed of the present invention may equipped with a feedback control system that partially or wholly automates measurement and control of the height and/or inclination of the blade. Such a control system may include additional structural devices that control the blade height and/or inclination, such as hydraulic, mechanical or electromechanical actuators. In such an embodiment, the operator(s) may simply move the screed across the concrete surface while the control system partially or wholly controls the position of the blade.

Figure 12:
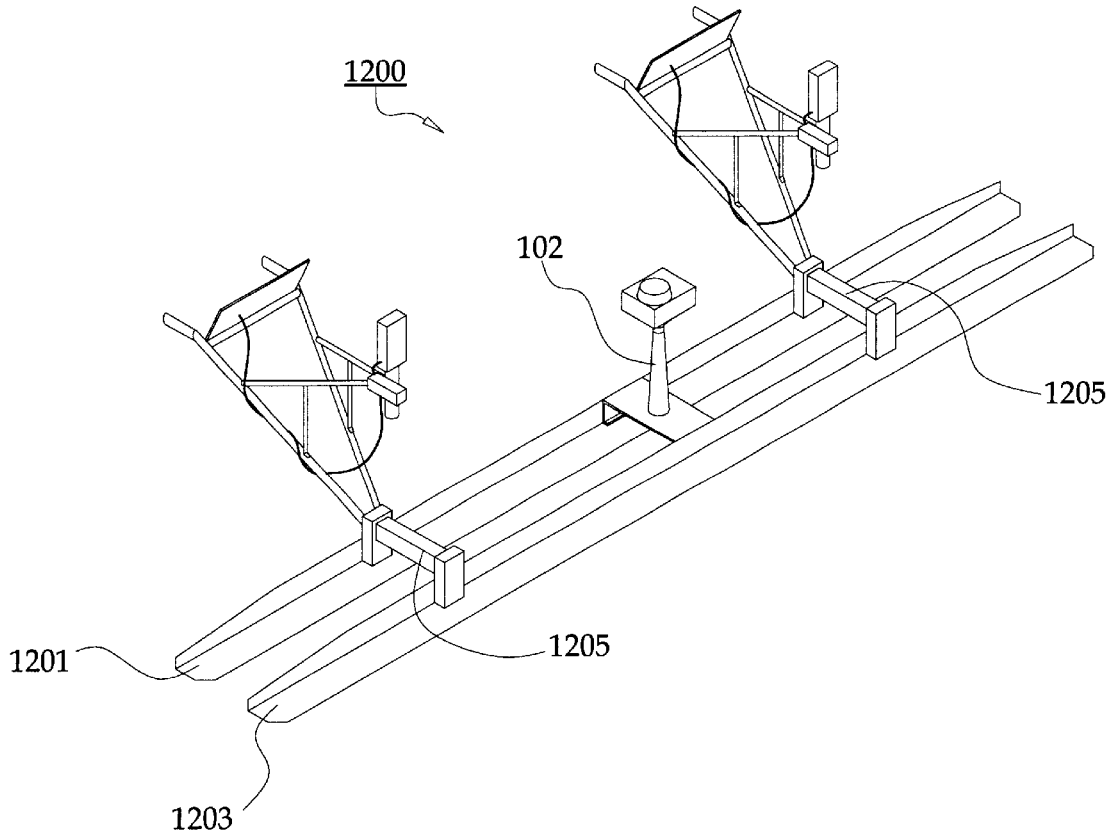
FIG. 12 is an isometric view of a preferred embodiment of a two-man, compound-blade portable screed of the present invention.

In another preferred embodiment of the invention, the portable screed may comprise more than one blade. Such multi-blade designs are referred to herein generally as compound-blade screeds. A compound-blade may have, for example, a staggered arrangement (the centerline (in the direction of the tilt axis 198) of one blade is offset relative to the centerline of the other), a side-by-side arrangement (the blades do not overlap in a plane parallel to the tilt axis 198), or tandem blades (the blades are substantially aligned along their centerlines (in the direction of the tilt axis 198)). Preferably, the blades are arranged so that at least a portion of the path the rearward blade(s) overlaps at least a portion of the path of the forward blade(s), such that the two blades provide some degree of screeding action over the same point or area during operation (i.e., in a staggered or tandem arrangement). An exemplary embodiment of a compound-blade screed is shown in FIG. 12, which depicts a screed having a tandem blade arrangement. The compound-blade screed 1200 of FIG. 12 comprises a fore blade 1201 (in the forward position) and an aft blade 1203 (in the rearward position), that are joined to one another by rigid structures 1205 (although they may be joined by isolation mounts in other embodiments). The vibrator assembly 102 is mounted between the blades so that a single vibrator assembly 102 may be used to vibrate both blades. Alternatively, additional vibrator assemblies 102 may be used, and such assemblies may be mounted to one or both of the blades 1201, 1203.

In the embodiment shown in FIG. 12 the fore blade and aft blades 1202, 1203 are made from identical extrusions, however the fore and aft blades 1201, 1203 may have different shapes, widths, lengths or other geometric or dimensional differences. Of course, in still other embodiments the fore and aft blades 1201, 1203 may be formed from a single piece of material that is shaped to present itself to the concrete surface as two or more distinct contact patches. Additionally, the compound-blade may comprise more than two blades.

Compound-blade screeds of the present invention, such as compound-blade screed 1200 of FIG. 12, may provide additional stability and resistance to sinking into particularly wet concrete. Compound-blade screeds also may provide additional finish quality to the concrete, and other benefits, as will be apparent to those skilled in the art with practice of the present invention.

EXAMPLE

Examples of a embodiments of the present invention have been tested and shown to provide superior performance over similar conventional portable screeds. The results of a back-to-back comparison of a conventional portable screed and a portable screed of the present invention are shown in Table 1. The conventional portable screed comprised a two-man VIBRA STRIKE II handle and vibrator assembly (available from Lindley, Incorporated of Boaz, Ky.) attached to a MAGIC SCREED blade (Allen Engineering of Paragould, Ark.). The exemplary screed of the present invention comprised a two-man screed having the general structure of the embodiment of FIG. 1, the vibrator assembly configuration of FIG. 3 and the handle and sensor configuration of FIGS. 4 and 8B. The exemplary screed of the present invention comprised a MAGIC SCREED blade (Allen Engineering), a single center-mounted vibrator assembly, two LIGHTNING LASER DETECTOR laser sensor eyes (Apache Technologies, Inc. of Dayton, Ohio.), and two digital inclinometers (R&B Manufacturing of Riverside, Mo.). The conventional screed and the screed of the present invention were operated in substantially the same manner and at the same location.

TABLE 1

| | Conventional Screed | | Present Invention 1st trial) | | Present Invention (2nd trial) | |
|---|---|---|---|---|---|---|
| Run # | $F_F$ | $F_L$ | $F_F$ | $F_L$ | $F_F$ | $F_L$ |
| 1 | 19.47 | 22.96 | 45.67 | 41.38 | 68.02 | 38.20 |
| 2 | 35.29 | 30.89 | 32.67 | 33.73 | 53.41 | 53.54 |
| 3 | 30.90 | 19.36 | 51.31 | 52.60 | 65.28 | 27.97 |
| 4 | 28.36 | 29.88 | 40.97 | 33.95 | 56.62 | 28.39 |
| 5 | 35.23 | 16.11 | 40.57 | 26.30 | 65.64 | 35.23 |
| 6 | 40.72 | 25.24 | 37.00 | 54.83 | 51.00 | 33.20 |
| 7 | 33.31 | 38.29 | | | | |
| 8 | 32.51 | 25.15 | | | | |
| Total* | 29.84 | 23.75 | 40.11 | 36.64 | 58.87 | 33.76 |

*"Total" value is based on ASTM E-1155 testing calculations, not the arithmetic average value The measurements of Table 1 were performed by an independent consulting any in accordance with ASTM E-1155 using a DIPSTICK FLOOR PROFILER available The Face Companies of Norfolk, Va. As can be seen from Table 1, the screed present invention provided average $F_F$ and $F_L$ values that exceed those of the conventional screed by about 50%, without requiring any substantial modification to the screeding procedure or additional costs other than those associated with the equipment. In fact, the screed of the present invention provided $F_L$ values that are approaching or comparable to those generally obtained by expensive laser-guided mobile screeds, such as those available from Somero Enterprises of Jaffney, N.H.

Other embodiments, uses, and advantages of the invention will be apparent to those skilled in the art from consideration of the specification and practice of the invention disclosed herein. The specification should be considered exemplary only, and the scope of the invention is accordingly intended to be limited only by the following claims.

I claim:

1. A portable screed comprising:

a blade;

one or more handles operatively associated with the blade;

one or more inclination sensors adapted to measure and indicate the inclination of the portable screed during screeding; and one or more level sensors adapted to measure and indicate the vertical position of the screed relative to a reference signal during screeding.

2. The portable screed of claim 1, further comprising a vibrator assembly for vibrating at least the blade.

3. The portable screed of claim 1, wherein the blade is a floating blade.

4. The portable screed of claim 1, wherein the blade is a compound blade.

5. The portable screed of claim 1, wherein the one or more inclination sensors comprise mechanical inclinometers.

6. The portable screed of claim 1, wherein the one or more inclination sensors comprise electronic inclinometers.

7. The portable screed of claim 1, further comprising one or more remote inclination displays adapted to be positionable remote from the one or more inclination sensors.

8. The portable screed of claim 1, wherein the reference signal comprises a laser and the one or more level sensors comprise laser sensor eyes.

9. The portable screed of claim 1, further comprising one or more remote level displays adapted to be positionable remote from the one or more level sensors.

10. The portable screed of claim 1, wherein the one or more level sensors are positioned approximately vertically above the blade.

11. The portable screed of claim 1, wherein the one or more level sensors are not positioned approximately vertically, above the blade.

12. The portable screed of claim 1, wherein at least one of the one or more level sensors and the one or more inclination sensors is adjustably mounted.

13. The portable screed of claim 1, further comprising one or more control panels, the control panels each comprising at least one of an inclination display and a level display.

14. The portable screed of claim 1, further comprising one or more control units, the control units each comprising at least one of an inclination display and a level display.

15. The portable screed of claim 14, wherein the one or more control units comprise at least one of an audible indicator and a visual indicator adapted to signal when one of both of the measured fore-aft angular orientation and the measured vertical position is outside a predetermined tolerance.

16. The portable screed of claim 1, further comprising one or more tilt sensors operatively associated with the blade and adapted to measure and indicate the tilt of the portable screed during screeding.

17. The portable screed of claim 16, wherein the one or more tilt sensors comprise electronic inclinometers.

18. The portable screed of claim 16, further comprising one or more remote tilt displays adapted to be positionable remote from the one or more tilt sensors.

19. The portable screed of claim 16, further comprising one or more tilt displays positioned on one or more control panels.

20. The portable screed of claim 16, further comprising one or more tilt displays integrated into one or more control units.

21. A two-man portable screed comprising:

a blade;

first and second handles operatively associated with the blade;

first and second inclination sensors adapted to measure and display first and second inclinations, respectively, of the portable screed during screeding; and first and second level sensors adapted to measure and display first and second vertical positions, respectively, relative to a reference signal during screeding.

22. The two-man portable screed of claim 21, wherein the first inclination sensor and the first level sensor are disposed proximal to the first handle and the second inclination sensor and the second level sensor are disposed proximal to the second handle.

23. The two-man portable screed of claim 21, further comprising at least one vibrator assembly for vibrating at least the blade.

24. The two-man portable screed of claim 23, wherein the vibrator assembly is operatively associated with the blade between the first and second handles.

25. The two-man portable screed of claim 21, wherein the blade is a floating blade.

26. The two-man portable screed of claim 21, wherein the blade is a compound blade.

27. The two-man portable screed of claim 21, wherein the one or more inclination sensors comprise electronic inclinometers.

28. The two-man portable screed of claim 21, further comprising one or more remote inclination displays adapted to be positionable remote from the one or more inclination sensors.

29. The two-man portable screed of claim 21, wherein the reference signal comprises a laser and the one or more level sensors comprise laser sensor eyes.

30. The two-man portable screed of claim 21, further comprising one or more remote level displays adapted to be positionable remote from the one or more level sensors.

31. The two-man portable screed of claim 21, wherein at least one of the one or more level sensors and the one or more inclination sensors is adjustably mounted.

32. The two-man portable screed of claim 21, further comprising first and second control panels positioned proximal to the first and second handles, respectively, each control panels comprising at least one of an inclination display and a level display.

33. The two-man portable screed of claim 21, further comprising first and second control units, each control unit comprising at least one of an inclination display and a level display.

34. The two-man portable screed of claim 33, wherein the first and second control units comprise at least one of an audible indicator and a visible indicator adapted to signal when one of both of the measured fore-aft angular orientation and the measured vertical position is outside a predetermined tolerance.

* * * * *